US005692347A

United States Patent [19]

Hulek

[11] Patent Number: 5,692,347

[45] Date of Patent: Dec. 2, 1997

[54] CORRUGATED METAL SHEET

[76] Inventor: Anton J. Hulek, Goglerfeldgasse 15, A-4040 Linz, Austria

[21] Appl. No.: 693,901

[22] Filed: Aug. 5, 1996

[51] Int. Cl.[6] ..... B61D 17/12

[52] U.S. Cl. ..... 52/537; 428/603; 428/595; 52/783.11; 52/798.1

[58] Field of Search ..... 52/537, 630, 798.1, 52/783.11, 783.17, 783.19; 428/174, 177, 182, 603, 595

[56] References Cited

U.S. PATENT DOCUMENTS

| | | | |
|---|---|---|---|
| 2,526,323 | 10/1950 | Blaski | 52/537 X |
| 2,878,553 | 3/1959 | Hirsch | 428/603 |
| 3,045,301 | 7/1962 | Webbere | 428/603 X |
| 3,059,733 | 10/1962 | Hermann | 52/537 X |
| 3,111,788 | 11/1963 | Ouellet | 52/537 |
| 3,124,427 | 3/1964 | Chomes | 428/603 |
| 3,206,902 | 9/1965 | Turnbull et al. | 52/783.11 X |
| 3,254,968 | 6/1966 | Bender | 428/603 X |
| 3,273,976 | 9/1966 | Wogerbauer | 428/603 |
| 3,801,419 | 4/1974 | Meek | 428/182 X |
| 4,014,148 | 3/1977 | Harter | 52/537 X |
| 4,096,679 | 6/1978 | Naz | 52/537 X |
| 4,273,681 | 6/1981 | Nonnenmann | 428/603 X |
| 4,358,916 | 11/1982 | Lacasse | 52/537 X |
| 4,375,491 | 3/1983 | Honig | 428/182 X |
| 4,472,473 | 9/1984 | Davis et al. | 428/182 X |
| 4,987,716 | 1/1991 | Boyd | 52/537 X |
| 5,413,872 | 5/1995 | Faigle | 428/603 |

FOREIGN PATENT DOCUMENTS

| | | |
|---|---|---|
| 0 369 158 | 5/1990 | European Pat. Off. . |
| 2 0 14 936 | 10/1970 | Germany . |
| WO 93/05901 | 4/1993 | WIPO . |

*Primary Examiner*—Lanna Mai
*Attorney, Agent, or Firm*—Collard & Roe, P.C.

[57] ABSTRACT

A corrugated metal sheet for covering a wall, ceiling or roof, the metal sheet having longitudinally extending edges defining therebetween a width of the metal sheet, and the metal sheet having a corrugation including first grooves extending along the edges and parallel thereto, and second grooves extending regularly over the width between the first grooves, the second grooves extending transversely to the first grooves.

6 Claims, 2 Drawing Sheets

CORRUGATED METAL SHEET

BACKGROUND OF THE INVENTION

1. Field of the Invention

The present invention relates to a corrugated metal sheet for covering a wall, ceiling or roof, the metal sheet having longitudinally extending edges defining therebetween a width of the metal sheet, and the metal sheet having a corrugation comprised of first grooves extending along the edges, and second grooves extending regularly over the width between the first grooves, the first and second grooves being differently shaped.

2. Description of the Prior Art

All conventional profiled metal sheets used for wall or ceiling facings or coverings as well as for roof covers have profiling which extends parallel to the edges so that the stiffness is correspondingly oriented.

German patent No. 2,014,936 discloses a metal tile which has a support rim along its circumference and recesses whose depth corresponds to the height of the rim so that the recesses also serve as support. Such metal tiles cannot be considered as corrugated metal sheets and are not profiled to improve their stiffness but are merely designed to provide improved support faces.

WO-93/05901-A discloses a band-shaped material having a special corrugation designed to enhance the stiffness of the material while maintaining its flexibility to a large extent, which is achieved by a very flat sinuous profile. This, too, is not a corrugated facing or cover for walls, ceilings or roofs.

European patent No. 369,158 discloses a slab- or band-shaped element useful in construction, comprised of a sheet metal slab with rims projecting at an angle from the slab and having a three-dimensional surface. The three-dimensional surface is designed to improve the appearance as compared to a flat surface.

SUMMARY OF THE INVENTION

According to this invention, a corrugated metal sheet of the first-indicated type has a corrugation comprised of first grooves extending along the edges and parallel thereto, and second grooves extending regularly over the width between the first grooves, the second grooves extending transversely to the first grooves. If the second grooves extend obliquely to the first grooves, they provide stiffness components in the longitudinal as well as transverse directions, and their shape and orientation determine the distribution of these components. The longitudinally extending grooves along the edges provide not only a stiffness component but also make it possible to lay adjacent corrugated metal sheets with overlapping edges so that these metal sheets can be used as facings or covers for walls, ceilings and roofs.

According to one feature of the invention, the second grooves extend sinuously and parallel to each other at uniform distances from each other, for instance perpendicularly to the first grooves. This provides static as well as optical advantages so that such corrugated metal sheets are particularly useful for facings in residential structures and interiors.

According to another preferred feature, the first grooves extending along both edges have the same cross sections as, and preferably have a larger depth than, the second grooves. This makes it possible to lay the corrugated metal sheets in a locking relationship and to provide a tight connection between the adjacent sheets.

BRIEF DESCRIPTION OF THE DRAWING

The above and other objects and features of the present invention will become more apparent from the following detailed description of certain now preferred embodiments thereof, taken in conjunction with the accompanying drawing wherein.

DETAILED DESCRIPTION OF PREFERRED EMBODIMENTS

Figure 1:
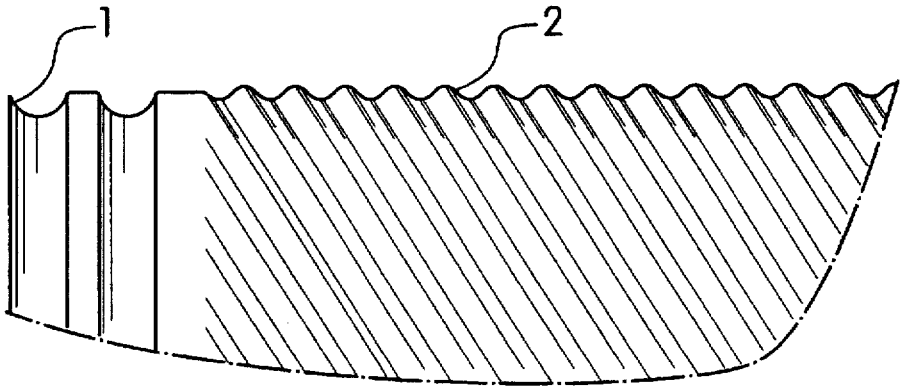
FIG. 1 is a fragmentary oblique top view of one embodiment of a corrugated metal sheet according to this invention.

Referring now to the drawing, there is shown a corrugated metal sheet for covering a wall, ceiling or roof. The metal sheet has longitudinally extending edges defining therebetween a width of the metal sheet, and the metal sheet has a corrugation comprised of first grooves 1 extending along the edges and parallel thereto, and second grooves 2 extending regularly over the width between first grooves 1, second grooves 2 extending transversely to the first grooves. As shown in FIG. 1, second grooves 2 extend rectilinearly and obliquely to first grooves 1.

Figure 3:
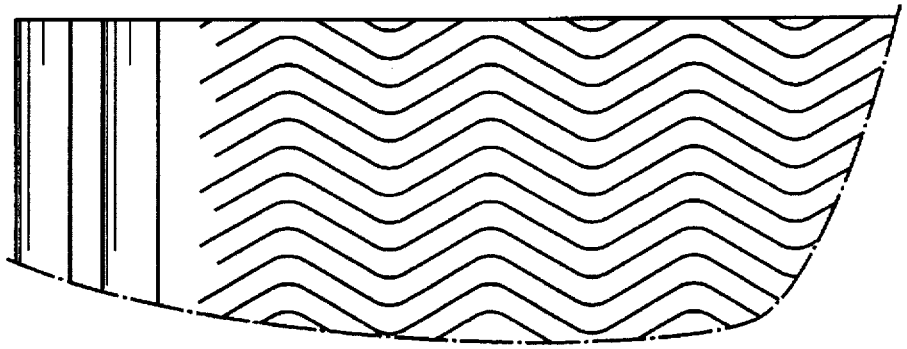
FIGS. 3 and 4 are fragmentary top views of two additional embodiments.
Figure 4:
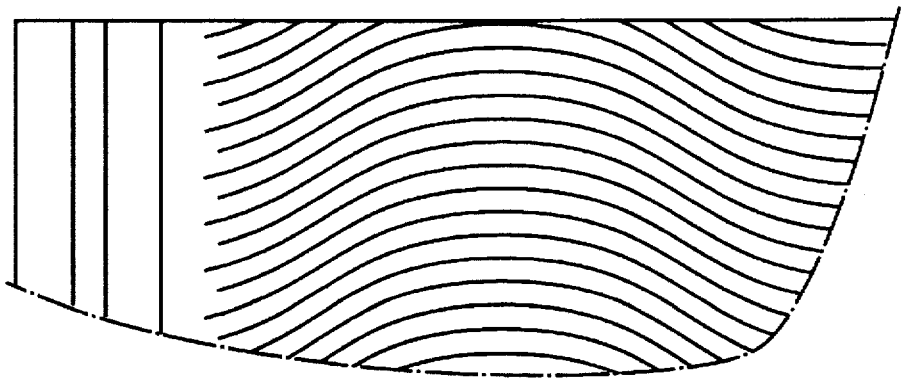

In the embodiments of FIGS. 3 and 4, the second grooves extend sinuously and parallel to each other at uniform distances from each other, extending perpendicularly to the first grooves. In FIG. 3, the sinuous shape of the grooves assume a zig-zag form while it is wave-shaped in FIG. 4.

Figure 2:
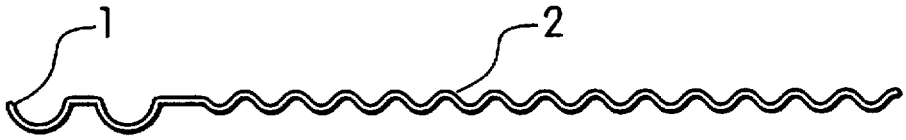
FIG. 2 is a transverse cross section of the corrugated metal sheet of FIG. 1.
Figure 5:
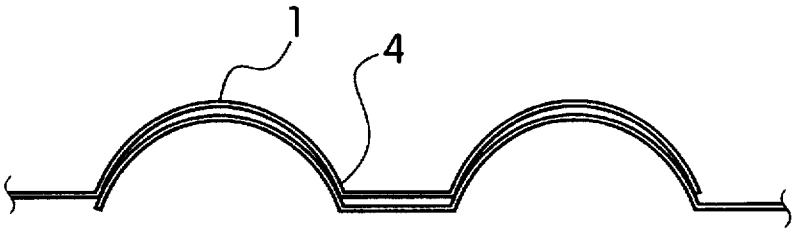
FIGS. 5 and 6 show enlarged fragmentary transverse cross sections along the longitudinal edges of two corrugated metal sheets laid side-by-side.
Figure 6:
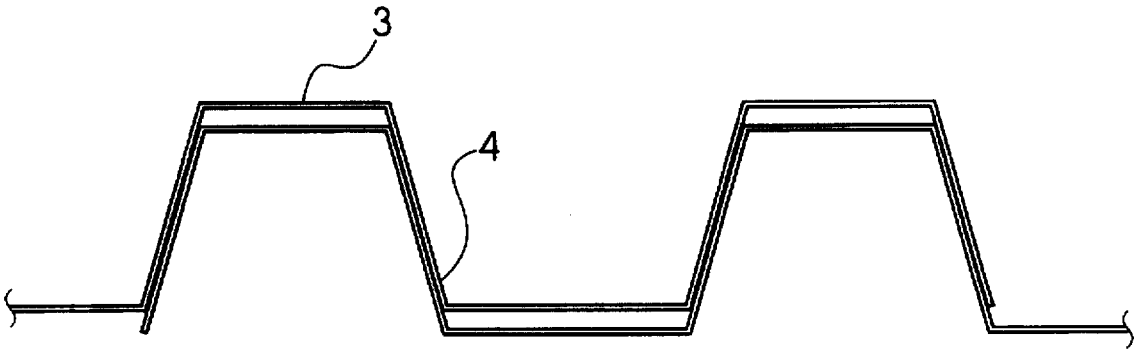

Longitudinally extending grooves 1 at least one each extending along the edges are of arcuate cross section, as shown in FIGS. 1, 2 and 5 but they may also be of trapezoid shape, as shown by grooves 3 in FIG. 6. These grooves extending along both edges have the same cross section. As illustrated, the overlapping edges of adjacent corrugated metal sheets thus sit on flanks 4 of grooves 1 or 3 and provide a good fit and seal, which makes them particularly well suited for use in wall and ceiling facings as well as roof covers. Preferably, first grooves 1 or 3 have a larger depth than second grooves 2.

Usually, the corrugated metal sheets of the present invention will be screwed or otherwise affixed to the wall, ceiling or roof frame. If the grooves have a small depth, they may also be arched, providing corresponding elastic tensions which provide an additional stiffness to the wall or roof. This has an added acoustic advantage and helps to dampen unwanted noises, such as rain drops falling on a roof.

What is claimed is:

1. A corrugated metal sheet for covering a wall, ceiling or roof, the metal sheet having longitudinally extending edges defining therebetween a width of the metal sheet, and the metal sheet having a corrugation comprised of first grooves extending along the edges and parallel thereto, and second grooves extending regularly over the width between the first grooves, the second grooves extending transversely to the first grooves and at least substantial portions of the second grooves extending obliquely to the first grooves.

2. The corrugated metal sheet of claim 1, wherein the second grooves extend rectilinearly obliquely to the first grooves.

3. The corrugated metal sheet of claim 1, wherein the second grooves extend sinuously and parallel to each other at uniform distances from each other.

4. The corrugated metal sheet of claim 3, wherein the second grooves extend perpendicularly to the first grooves.

5. The corrugated metal sheet of claim 1, wherein the first grooves extending along both edges have the same cross section.

6. The corrugated metal sheet of claim 5, wherein the first grooves have a larger depth than the second grooves.

* * * * *